US005400680A

United States Patent [19]

Spangler

[11] Patent Number: 5,400,680

[45] Date of Patent: Mar. 28, 1995

[54] GOLF SHOE SPIKE WRENCH

[76] Inventor: William G. Spangler, 223 Wiley Bottom Rd., Savannah, Ga. 31411

[21] Appl. No.: 122,978

[22] Filed: Sep. 20, 1993

Related U.S. Application Data

[63] Continuation-in-part of Ser. No. 965,762, Oct. 23, 1992, abandoned.

[51] Int. Cl.[6] ..... B25B 13/48

[52] U.S. Cl. ..... 81/176.15; 81/176.3; 81/461; 81/459

[58] Field of Search ..... 81/176.1, 176.15, 176.2, 81/176.3, 121.1, 125, 461, 459

[56] References Cited

U.S. PATENT DOCUMENTS 748,923 1/1904 Bryant .
1,199,478 9/1916 Lum .
1,263,202 4/1918 Brown .
1,930,859 10/1933 Monro .
3,412,635 11/1968 Chmielewski .
4,262,562 4/1981 MacNeill .
4,480,514 11/1984 Ponziani .
4,828,221 5/1989 Scobie et al. .

FOREIGN PATENT DOCUMENTS 947813 1/1964 United Kingdom .

*Primary Examiner*—D. S. Meislin

[57] ABSTRACT

A golf shoe spike wrench for removing spike bodies encapsulated with thermoplastic resin from the sole of golf shoes having a wrench head containing two spaced screws adapted to engage two apertures in the thermoplastic encapsulated spike body. The screws are rotated with a screwdriver to securely fix the spike wrench to the spike body, and the wrench is then rotated to remove the spike body from the shoe sole. Other spike bodies which are of all steel construction are removed in exactly the same manner.

4 Claims, 1 Drawing Sheet

GOLF SHOE SPIKE WRENCH

This application is a continuation in part of application Ser. No. 07/965,762, filed Oct. 23, 1992, by the same inventor entitled "Golf Shoe Spike Wrench", now abandoned.

BACKGROUND OF THE INVENTION

The present invention relates to wrenches, and more particularly to a wrench for removing and/or replacing spikes on the soles of golf shoes. Spikes are attached to the sole of golf shoes to provide the golfer a firm stance on turf as the golfer swings to hit the golf ball.

Golf shoes until rather recently, were made of leather uppers and leather soles and heels. To the soles and heels were attached metal spikes by means of a male screw integral with the spike body engaging a female screw embedded in the sole of the shoe. The spikes were usually circular in shape with a concavo-convex surface, the convex surface facing away from the sole of the shoe. Two apertures were provided inward from the periphery of the spike body on either side of the spike to receive a spike wrench having affixed thereto two metal pins adapted to engage the apertures of the spike body for removing and/or replacing the spike body from the golf shoe sole. Approximately twelve spikes were provided on the sole of each shoe.

Over the past quarter century, there has been a veritable revolution in the materials utilized in making golf shoes and spikes. Synthetic materials are now commonly used for the uppers, the soles and even the spike bodies. The soles are made of a rubber-resin blend composition and the spike bodies in some cases are encapsulated in a thermoplastic jacket. The shape of the soles, the shape of the spike bodies and the number of spikes per shoe remain substantially the same. Two factors resulted in the present invention. First, the thermoplastic encapsulated spike bodies tend to "weld" to the sole composition and consequently become very difficult to remove. Secondly, the thermoplastic encapsulated spike bodies damage rather readily when a conventional metal spike wrench is employed to remove them for replacement with new spike bodies. Because of the aforementioned "welding" effect and the damage caused by the conventional metal spike wrench, it is oftentimes practically impossible to remove the spike bodies from the shoes.

SUMMARY OF THE INVENTION

A very simple, efficient spike wrench which effectively removes spike bodies from the soles of golf shoes is provided. The present spike wrench utilizes two screws which are inserted in the spike body apertures and rotated by a screwdriver to securely engage the apertures of the spike body to efficiently and effectively remove the spike body from the shoe sole when the wrench is turned.

BRIEF DESCRIPTION OF THE INVENTION

Figure 2:
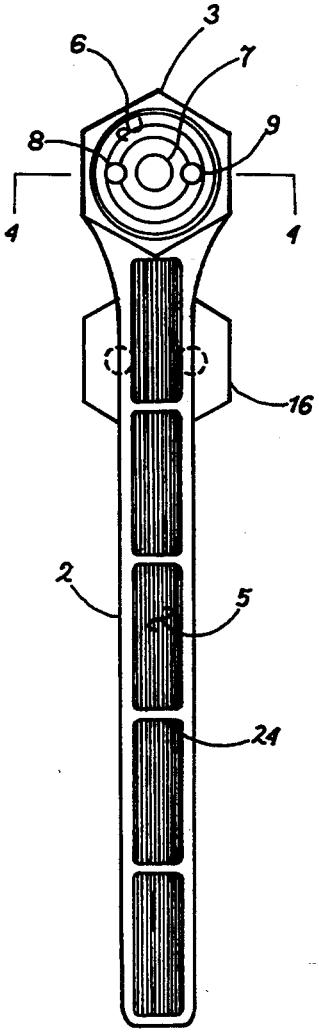
FIG. 2 is a bottom plan view.

The spike wrench of the present invention comprises a body 1 having a handle 2, a hexagonal-shaped head 3 and an auxiliary head 16. The body 1 can be made of any castable or moldable material. For lightweight, it is preferably made of a good quality, moldable engineering plastic, such as, nylon, polycarbonate, graft ABS copolymer such as Cycolac resin, or the like. To further reduce the weight of the wrench and to increase its strength, cavities 5 with reinforcing ribs 24 are provided (FIG. 2) in the handle 2.

The hexagonal-shaped head 3 embodies the crux of my invention and comprises a convex-shaped recess 6 being further recessed at 7. The recesses 6 and 7 are adapted to receive the circular convex shaped spike body 25 including the spike 26. The spike body 25, in FIG. 5, is shown embedded in a golf shoe sole 27.

Figure 4:
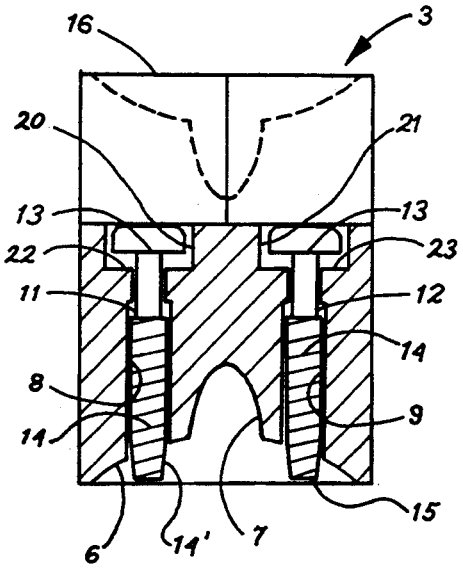
FIG. 4 is an enlarged sectional view taken on the line 4—4 of FIG. 2.
Figure 3:
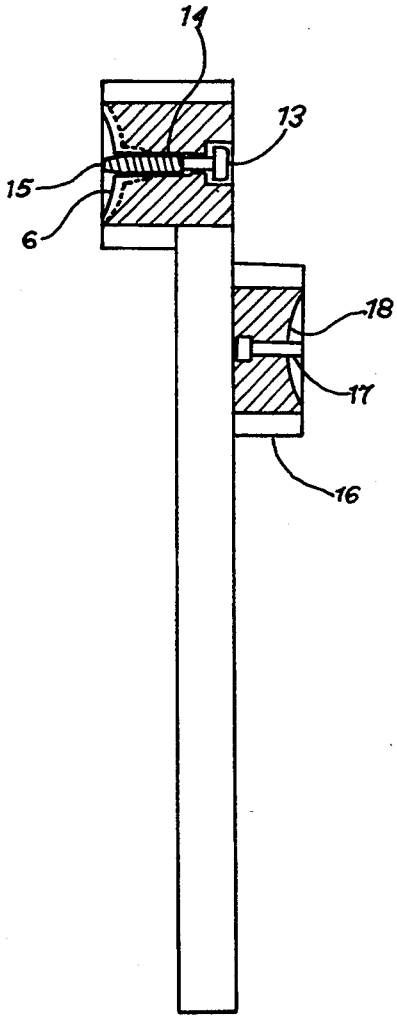
FIG. 3 is a side elevational view, partly in section.

Referring now to FIG. 4, two elongated holes 8, 9 are provided in the head 3 for receiving two screws 11, 12. The holes 8, 9 are counterbored at 20, 21 to receive the heads 13, 13 of the screws 11, 12. The counter bores produce flanges 22, 23. Each of the screws has a head 13 and a helical threaded shank 14 with preferably a tapered or conical tip having a continuation of the helical threads as shown at 14'. The head 13 is preferably of the Phillips type but other screws will work, such as slotted head screws. The screws 11, 12 have a blunt end 15 to prevent screw engagement with and damage to the sole of the shoe to which the spikes are attached. The auxiliary head 16 is provided on the wrench body 1 and contains standard juxtaposed metal pins 17 embedded in the body as shown in FIG. 3. The auxiliary head 16 is not a part of my invention, but is provided for quick and easy attachment of spike bodies to a shoe sole. The head 16 has a concave portion 18 and a recess 19 adapted to receive a spike body and spike respectively. The spike body 25 has two juxtaposed apertures 28, 29, (see FIG. 5) adapted to normally receive the standard juxtaposed pins of a conventional golf shoe spike wrench.

Figure 5:
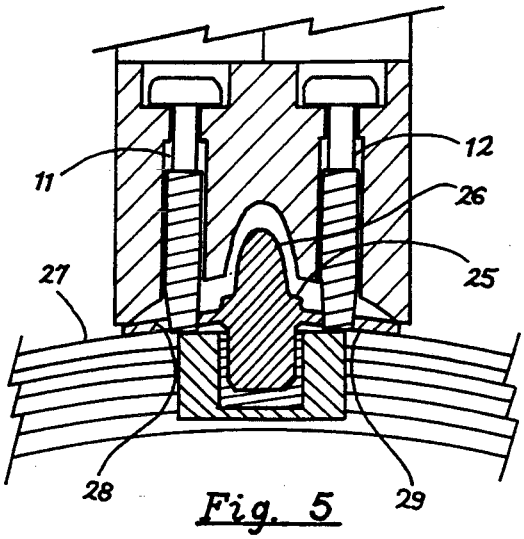
FIG. 5 is an enlarged fragmentary sectional view showing the manner in which the wrench engages a spike body.
Figure 1:
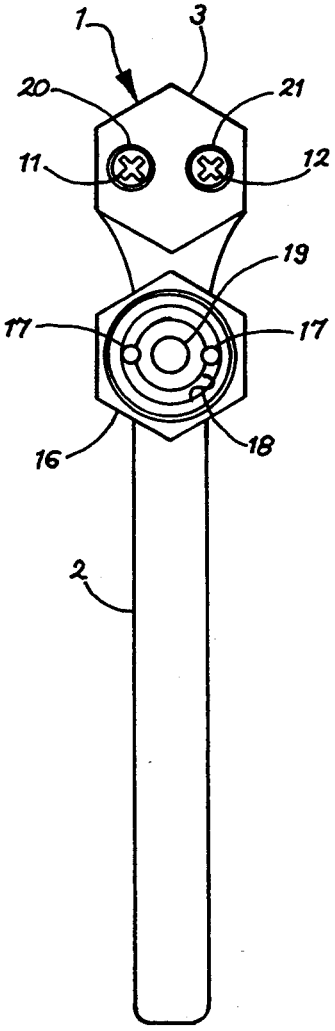
FIG. 1 is a top plan view of the wrench.

In operation, the head 3 of the present wrench is placed over and in contact with the spike body 25 of the shoe sole 27, as shown in FIG. 5. A screwdriver is utilized to rotate the screws 11, 12. As the screws 11, 12 are rotated, the conical tips of the screws engage the two apertures 28, 29 of the spike body 25 thereby locking securely into the spike body. The wrench is then rotated in a counterclockwise direction to remove the spike body from the shoe sole. For replacing a spike body, the head 16 with its pins 17 is placed over the spike body which is in contact with the shoe sole. The wrench is then rotated clockwise to attach the spike body to the shoe sole.

I claim:

1. A golf shoe spike wrench adapted to remove a spike from the sole of a golf shoe, said spike having a circular, concave-convex body having at least two apertures therein adapted to normally receive the standard juxtaposed pins of a conventional golf shoe spike wrench, said spike wrench including a handle and a head, said head having a top, and a bottom with a concaved-shaped recess and having at least one elongated hole therein running from the top to the bottom of said head, said elongated hole containing an elongated screw having a head and a helical threaded shank, said helical threaded shank having a tapered helical threaded shank portion whereby when said concave shaped recess of said wrench head is positioned over the convex shaped spike body with the screw aligned with and placed in contact with one of said apertures, and the screw is rotated clockwise to engage one of said apertures and fixedly secure said screw to said spike body, and the wrench is rotated counterclockwise by means of said handle, the spike body is removed from the shoe sole.

2. A golf shoe spike wrench, in accordance with claim 1 where two elongated juxtaposed holes are provided and two elongated screws are contained in said elongated holes.

3. A golf shoe spike wrench in accordance with claim 1 wherein said elongated screw has a conical tip and a blunt end.

4. A golf shoe spike wrench according to claim 2 wherein each said elongated screws have conical tips with blunt ends.

* * * * *